US010047753B2

(12) United States Patent
Sorokes et al.

(10) Patent No.: US 10,047,753 B2
(45) Date of Patent: Aug. 14, 2018

(54) SYSTEM AND METHOD FOR SIDESTREAM MIXING

(71) Applicants: James M. Sorokes, Olean, NY (US); Harry F. Miller, Allegany, NY (US)

(72) Inventors: James M. Sorokes, Olean, NY (US); Harry F. Miller, Allegany, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 381 days.

(21) Appl. No.: 14/202,033

(22) Filed: Mar. 10, 2014

(65) Prior Publication Data

US 2016/0076545 A1 Mar. 17, 2016

(51) Int. Cl.

| | |
|---|---|
| ***F04D 17/12*** | (2006.01) |
| ***F04D 17/10*** | (2006.01) |
| ***F04D 19/02*** | (2006.01) |
| ***F04D 29/42*** | (2006.01) |
| ***F04D 29/52*** | (2006.01) |
| ***F04D 29/70*** | (2006.01) |

(52) U.S. Cl.

CPC ..... *F04D 17/12* (2013.01); *F04D 17/10* (2013.01); *F04D 19/02* (2013.01); *F04D 29/4213* (2013.01); *F04D 29/524* (2013.01); *F04D 29/701* (2013.01)

(58) Field of Classification Search

CPC .. F04D 27/0238; F04D 27/023; F04D 25/028; F04D 25/163; F04D 15/0016

See application file for complete search history.

(56) References Cited

U.S. PATENT DOCUMENTS

| | | | |
|---|---|---|---|
| 4,644,207 | A | 2/1987 | Catterfeld et al. |
| 5,139,547 | A | 8/1992 | Agrawal et al. |
| 6,158,240 | A | 12/2000 | Low et al. |

(Continued)

FOREIGN PATENT DOCUMENTS

| | | | |
|---|---|---|---|
| JP | S4875952 | A | 10/1973 |
| JP | S5364307 | U | 5/1978 |
| WO | 2012012018 | A2 | 1/2012 |

OTHER PUBLICATIONS

European Patent Office, "Extended European Search Report—EP 14774106", dated Sep. 16, 2016, 6 pages.

(Continued)

*Primary Examiner* — Justin Seabe
*Assistant Examiner* — Juan G Flores

(57) ABSTRACT

Systems and methods are provided for sidestream mixing. The system may include a first junction formed from a plurality of conduits. The plurality of conduits may include a first conduit fluidly coupled to a compressor, the first conduit forming a first conduit diameter and configured to flow therethrough a first process fluid stream of a plurality of process fluid streams. The plurality of conduits may also include a second conduit fluidly coupled to the first conduit and the compressor, and configured to flow therethrough a second process fluid stream of the plurality of process fluid streams. The first junction may be disposed a first distance at least three times the first conduit diameter upstream of the compressor, such that the first process fluid stream and the second process fluid stream are mixed and form a first combined process fluid stream prior to being fed into and pressurized in the compressor.

17 Claims, 6 Drawing Sheets

(56) References Cited

U.S. PATENT DOCUMENTS

| | | | | |
|---|---|---|---|---|
| 8,980,195 | B2 * | 3/2015 | Pelton | C10J 3/485 422/214 |
| 9,074,606 | B1 * | 7/2015 | Moore | F04D 17/12 |
| 2002/0170312 | A1 | 11/2002 | Reijnen et al. | |
| 2008/0165613 | A1 | 7/2008 | Dykstra | |
| 2013/0058800 | A1 | 3/2013 | Sites | |

OTHER PUBLICATIONS

International Searching Authority, "International Search Report" and "Written Opinion of the International Searching Authority—PCT/US2014/023293", Aug. 21, 2014, 7 pages.
Koch et al., "Modeling and Prediction of Sidestream Inlet Pressure for Multistage Centrifugal Compressors", Sep. 12, 2015, 9 pages.
Sorokes et al., "Full-Scale Aerodynamic and Rotorydynamic Testing for Large Centrifugal Compressors", 2009, p. 71-80.
Sorokes et al., "Sidestream Optimization through the use of Computational Fluid Dynamics and Model Testing", 2000, p. 21-30.

* cited by examiner

SYSTEM AND METHOD FOR SIDESTREAM MIXING

CROSS-REFERENCE TO RELATED APPLICATIONS

This application claims priority to U.S. Provisional Patent Application having Ser. No. 61/781,383, which was filed Mar. 14, 2013. This priority application is hereby incorporated by reference in its entirety into the present application to the extent consistent with the present application.

BACKGROUND

Hydrocarbons, including liquefied natural gas (LNG) and ethylene, may be used in a refinery, or other petrochemical setting, as an energy source or source material for various processes. Typically, one or more compressors may be used in the processing of such hydrocarbons. In particular, the propane and propylene compressors utilized for the processing of LNG and ethylene, respectively, are typically beam-style, multi-stage centrifugal compressors.

Generally, a beam-style, multi-stage centrifugal compressor includes a casing and a plurality of stages disposed therein, each stage including an inlet guide, an impeller, a diffuser, and a return channel that collectively raise the pressure of the gas or working fluid. A main inlet of the beam-style, multi-stage centrifugal compressor receives the gas flow from an inlet pipe coupled to the main inlet, distributes the flow around the circumference of the casing, and injects the flow into the first inlet guide disposed immediately upstream of the impeller of the first stage. The gas is drawn into the impeller from the first inlet guide and driven (or propelled) to a tip of the impeller, thereby increasing the velocity of the gas. The centrifugal compressor may also include a diaphragm assembly including all of the various components contained within the back half or downstream end of the compressor stage. The diaphragm assembly may form at least in part the gas flow path of the centrifugal compressor.

The diaphragm assembly may include a diffuser proximate the tip of the impeller and in fluid communication therewith. The diffuser is configured to convert the velocity of the gas received from the impeller to potential energy in the form of increased static pressure, thereby resulting in the compression of the gas. The diaphragm assembly further includes a return channel in fluid communication with the diffuser and configured to receive the compressed gas from the diffuser and inject the compressed gas into a succeeding compressor stage. Otherwise, the compressed gas is ejected from the gas flow path via a discharge volute or collector that gathers the flow from the final stage and sends it down the discharge pipe.

Applications, such as propane refrigeration or propylene units for LNG and ethylene, respectively, generally require one or more flow streams, generally referred to as sidestream flows, to be introduced into the centrifugal compressor at respective flow inlets other than the main inlet. These sidestream flows may be introduced through additional flanges added to or formed in the casing. The additional inlets required for the sidestream flow typically necessitate corresponding components including, for example, sidestream inlet plenums and sidestream scoop vanes, to mix the sidestream flow with the working fluid in the centrifugal compressor.

The mixing of the sidestream flow and the working fluid typically occurs in the inlet guide of the respective stage, immediately upstream of the impeller. Improper or insufficient mixing can lead to pressure and temperature stratification (i.e., non-uniform pressure and temperature fields). Such skewed pressure and temperature fields degrade the performance of the downstream stage, causing the operating pressures to fall short of the process requirements. Moreover, it is often desirable to have the ability to adjust the performance of the compressor to match the process requirements via movable geometry (such as movable inlet guide vanes or movable diffuser vanes). Generally, it is much more challenging to install movable geometry in a beam-style compressor because of the limited space in which to install the drive mechanisms and linkages.

What is needed, then, is an efficient system including a compressor configured to provide for a working fluid and sidestream flow mix having a substantially uniform temperature and pressure field, and further configured to allow for the facile installation of movable geometry to provide for the tuning of the compressor for varying process requirements.

SUMMARY

Embodiments of the disclosure may provide a system for mixing and pressurizing a plurality of process fluid streams. The system includes at least one driver including a drive shaft, the driver configured to provide the drive shaft with rotational energy. The system may also include at least one compressor including a rotary shaft, the rotary shaft being operatively coupled to the drive shaft and configured such that the rotational energy from the drive shaft is transmitted to the rotary shaft. The system may further include a first junction formed from a first plurality of conduits. The plurality of conduits may include a first conduit fluidly coupled to the at least one compressor, the first conduit forming a first conduit diameter and configured to flow therethrough a first process fluid stream of the plurality of process fluid streams. The plurality of conduits may also include a second conduit fluidly coupled to the first conduit and the at least one compressor, the second conduit configured to flow therethrough a second process fluid stream of the plurality of process fluid streams. The first junction may be disposed a first distance at least three times the first conduit diameter upstream of the at least one compressor, such that the first process fluid stream and the second process fluid stream are mixed and form a first combined process fluid stream prior to being fed into and pressurized in the at least one compressor.

Embodiments of the disclosure may further provide a method for mixing and pressurizing a plurality of process fluid streams. The method includes driving a rotary shaft of at least one compressor via a first drive shaft operatively coupled to the rotary shaft, the first drive shaft driven by a first driver. The method may also include feeding a first process fluid stream of the plurality of process fluid streams through a first conduit having a first conduit diameter and fluidly coupled to the at least one compressor. The method may further include feeding a second process fluid stream of the plurality of process fluid streams through a second conduit coupled to the first conduit at a first junction disposed upstream of the at least one compressor a first distance of at least three times the first conduit diameter. The method may also include mixing the first process fluid stream and the second process fluid stream at the first junction, thereby forming a first combined process fluid stream. The method may further include feeding the first combined process fluid stream into the at least one compressor, and pressurizing the first combined process fluid stream in the at least one compressor.

Embodiments of the disclosure may further provide a system for removing at least a portion of a process fluid stream. The system may include at least one driver including a drive shaft, the driver configured to provide the drive shaft with rotational energy. The system may also include at least one compressor including a rotary shaft, the rotary shaft being operatively coupled to the drive shaft and configured such that the rotational energy from the drive shaft is transmitted to the rotary shaft. The system may further include a first junction formed from a first plurality of conduits. The first plurality of conduits may include a first conduit fluidly coupled to the at least one compressor, the first conduit forming a first conduit diameter and configured to flow therethrough the process fluid stream. The first plurality of conduits may also include a second conduit fluidly coupled to the first conduit and an external component, the second conduit configured to flow therethrough the at least a portion of the process fluid stream. The first junction may be disposed a first distance at least three times the diameter of the first conduit upstream of the at least one compressor, such that the at least a portion of the process fluid stream is removed from the process fluid stream and fed to the external component via the second conduit.

Embodiments of the disclosure may further provide a method for removing at least a portion of a process fluid stream. The method may include driving a rotary shaft of at least one compressor via a drive shaft operatively coupled to the rotary shaft, the drive shaft driven by a driver. The method may also include feeding the process fluid stream through a first conduit having a first conduit diameter and being fluidly coupled to the at least one compressor. The method may further include feeding the at least a portion of a process fluid stream through a second conduit coupled to the first conduit at a first junction disposed upstream of the at least one compressor a distance of at least three times the first conduit diameter, thereby removing the at least a portion of a process fluid stream from the process fluid stream.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
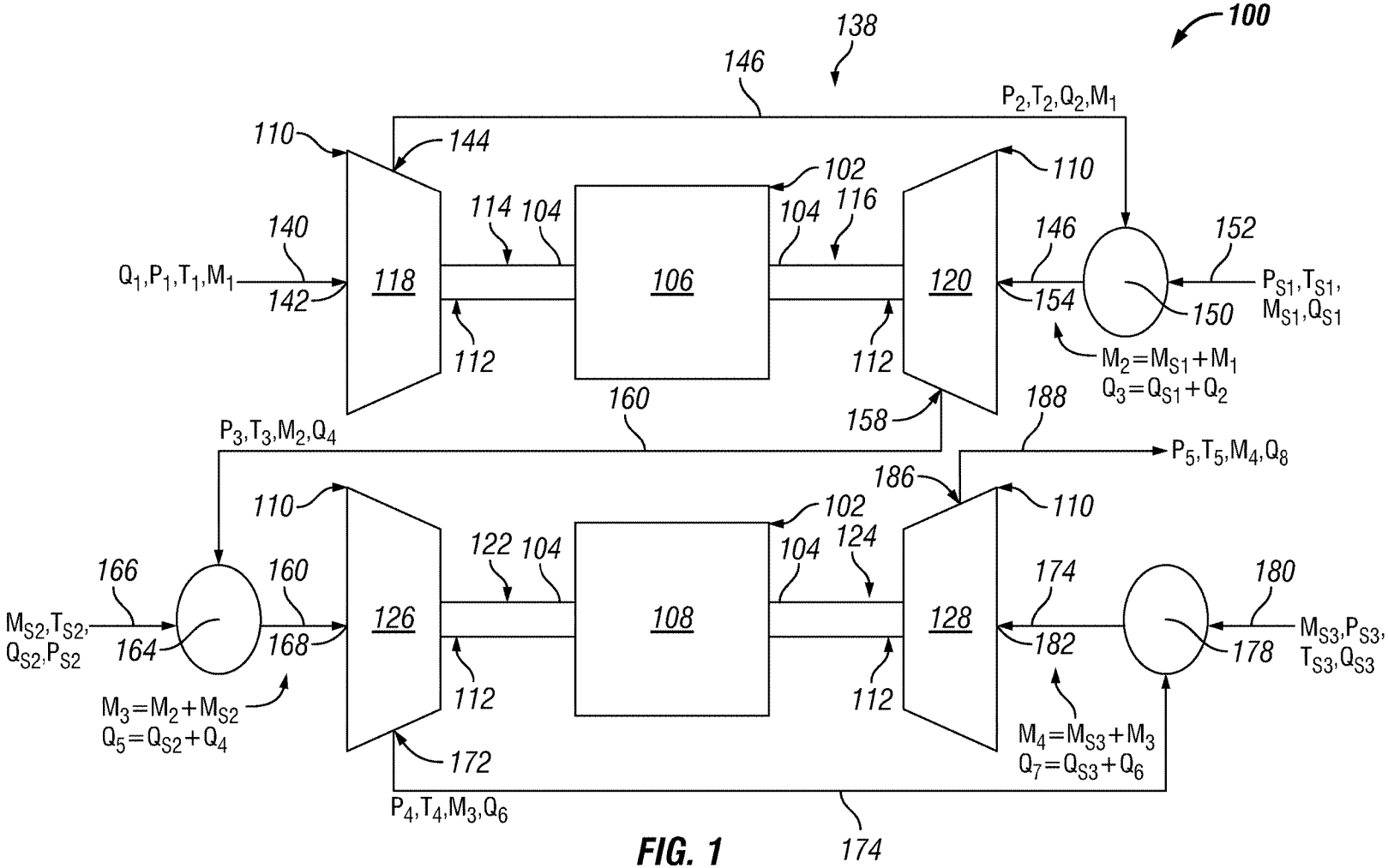
FIG. 1 illustrates a schematic diagram of a system for mixing and pressurizing a plurality of process fluid streams, the system including a plurality of compressors and a plurality of drivers, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2:
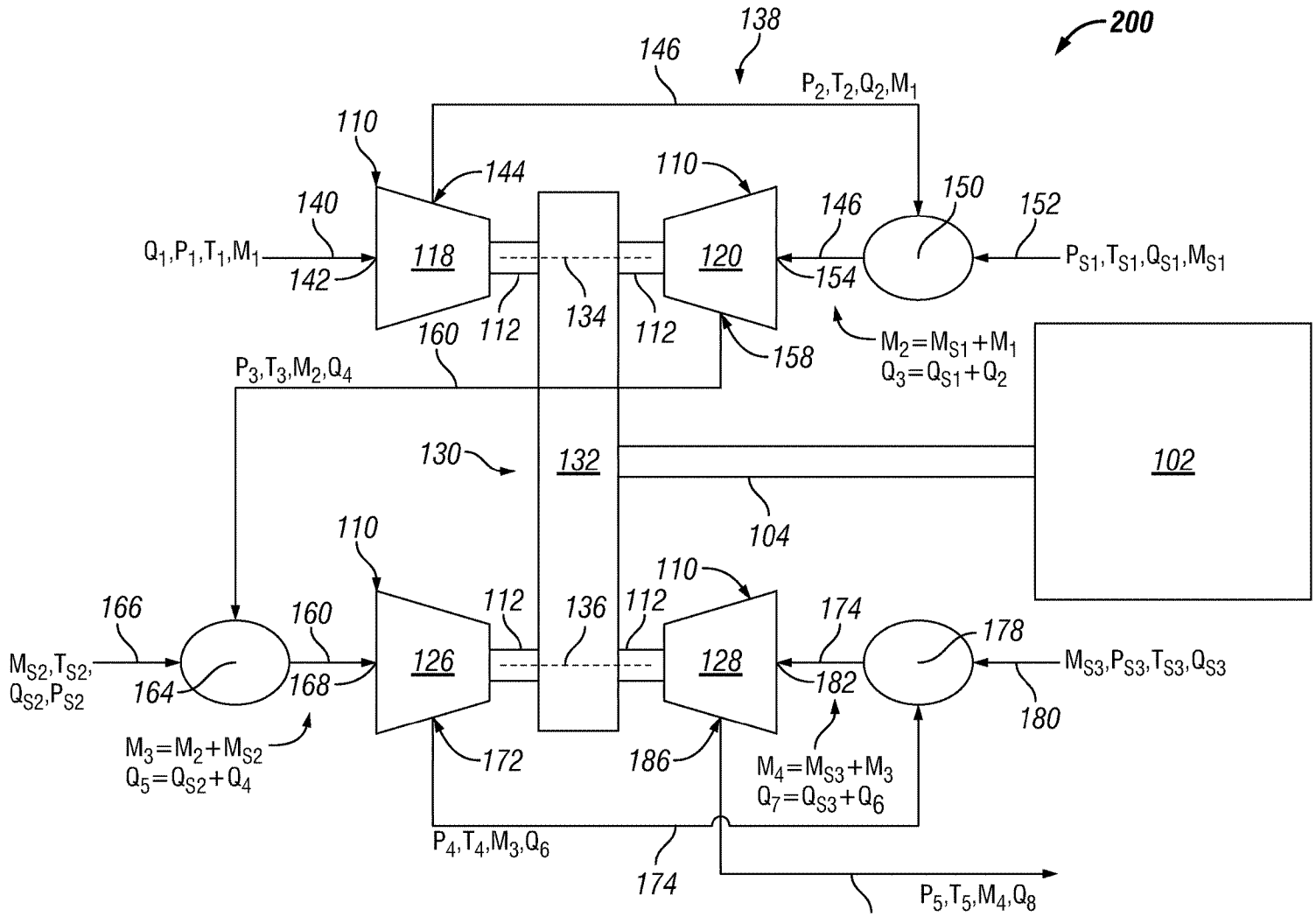
FIG. 2 illustrates a schematic diagram of another system for mixing and pressurizing a plurality of process fluid streams, the system including a plurality of compressors operatively coupled to a driver via a plurality of gears, according to one or more embodiments.

FIGS. 1 and 2 illustrate exemplary embodiments of a sidestream mixing system 100, 200 configured to efficiently and effectively mix and compress process fluid streams having differing temperatures, pressures, volumetric and/or mass flow rates. The sidestream mixing system 100,200 may be further configured to mix and compress process fluid streams fed into the sidestream mixing system 100, 200 via a plurality of sidestreams. In other exemplary embodiments shown in FIGS. 3 and 4, a sidestream mixing system 300, 400 may be configured to efficiently mix and remove at least a portion of a process fluid stream. The process fluid may include, for example, hydrocarbons, including LNG and ethylene; however, those of ordinary skill in the art will appreciate that the sidestream mixing system may process non-hydrocarbon-based process fluids, such as ammonia.

The sidestream mixing system 100, 200 may include one or more drivers 102, each driver 102 having a drive shaft 104 and configured to provide the drive shaft 104 with rotational energy. In the exemplary embodiment illustrated in FIG. 1, the sidestream mixing system 100 includes a plurality of drivers 102. In another exemplary embodiment illustrated in FIG. 2, the sidestream mixing system 200 includes a single driver 102. The driver 102 may be an electric motor, such as a permanent magnet motor having permanent magnets installed on a rotor portion (not shown) and further having a stator portion (not shown). As will be appreciated, other embodiments may employ other types of electric motors, such as, but not limited to, synchronous, induction, brushed DC motors, etc. Further, the driver 102 may be a hydraulic motor, an internal combustion engine, a gas turbine, or any other device capable of rotatably driving the drive shaft 104, either directly or through a power train. As shown in FIG. 1, the sidestream mixing system 100 may include a first driver 106 and a second driver 108; however, one of ordinary skill in the art will appreciate that the number of drivers 102 in the sidestream mixing system 100, 200 may vary based on numerous conditions, such as, for example, the type of compressor employed or the number of sidestreams fed into the sidestream mixing system.

As shown in FIG. 1, each driver 102 may be operatively coupled to a plurality of compressors 110. In an exemplary embodiment, the drive shaft 104 of each driver 102 may be integral with or coupled to a rotary shaft 112 of a respective compressor 110 at each end of the drive shaft 104 in a "double-ended" configuration. In such a configuration, each driver 102 drives a respective drive shaft 104, which in turn drives the rotary shafts 112 of the respective coupled compressors 110. In an exemplary embodiment, each driver 102 is coupled to two compressors 110. As shown in FIG. 1, the drive shaft 104 of the first driver 106 may have a first end 114 and a second end 116, such that the first end 114 is coupled to the rotary shaft 112 of a first compressor 118 and the second end 116 is coupled to the rotary shaft 112 of a second compressor 120. Likewise, the second driver 108 may have a first end 122 and a second end 124, such that the first end 122 is coupled to the rotary shaft 112 of a third compressor 126 and the second end 124 is coupled to the rotary shaft 112 of a fourth compressor 128.

In the exemplary embodiment of the sidestream mixing system 200 of FIG. 2, the drive shaft 104 of the driver 102 is coupled to a plurality of gears 130 configured to transmit the rotational energy of the drive shaft 104 to the rotary shafts 112 of the respective compressors 110. The plurality of gears 130 may include a plurality of spur gears, such that the spur gears include a bull gear 132, a first pinion 134, and a second pinion 136. In an exemplary embodiment, the bull gear 132 may be fitted on the drive shaft 104 of the driver 102 by press fitting or any other manner known to those in the art, such that the bull gear 132 rotates at the same speed as the drive shaft 104. The first pinion 134 and second pinion 136 may be fitted on the respective rotary shafts 112 of the compressors 110 by press fitting, or any other manner known to those in the art, and configured such that a plurality of teeth (not shown) defined by each of the first and second pinion 134, 136 interconnect with the teeth (not shown) of the bull gear 132, thereby rotating the rotary shafts 112 of the respective compressors 110 at a speed consistent with the gearing ratio between the bull gear 132 and each of the first and second pinions 134, 136. The first pinion 134 and second pinion 136 may have identical diameters or the pinions 134, 136 may have differing diameters, thereby creating different gearing ratios with respect to the bull gear 132 and causing differing rotary speeds of the corresponding rotary shafts 112 of the compressors 110.

As shown in FIG. 2, the first pinion 134 is operatively coupled to the respective rotary shafts 112 of the first compressor 118 and the second compressor 120. Likewise, the second pinion 136 is operatively coupled to the respective rotary shafts 112 of the third compressor 126 and fourth compressor 128. Embodiments in which the first and second compressors 118, 120 may be coupled via a common rotary shaft 112 and embodiments in which the third and fourth compressors 126, 128 may be coupled via a common rotary shaft 112 are contemplated herein.

In an exemplary embodiment, each compressor 110 may be a direct-inlet, centrifugal compressor. The direct-inlet or axial-inlet, centrifugal compressor may be, for example, a DATUM® ICS compressor manufactured by the Dresser-Rand Company of Olean, N.Y. In an exemplary embodiment, the compressors 110 illustrated in the sidestream mixing system 100 of FIG. 1 may be axial-inlet, centrifugal compressors. In another exemplary embodiment of the sidestream mixing system 200 illustrated in FIG. 2, each compressor 110 may be an integrally-geared compressor. The integrally-geared compressor may be, for example, an integrally-geared compressor from the Legacy ISOPAC and CVC lines of integrally-geared compressors manufactured by the Dresser-Rand Company of Olean, N.Y. Each integrally-geared compressor may be a single-stage compressor.

Each direct-inlet, centrifugal compressor of the sidestream mixing system 100 of FIG. 1 may be a single-stage or a multi-stage compressor. Further, one of ordinary skill in the art will appreciate that varying combinations of single-stage compressors and multi-stage compressors may be employed in the sidestream mixing system 100 of FIG. 1. Still yet, the sidestream mixing system 100 may employ either all or substantially all single-stage compressors or all multi-stage compressors. One of ordinary skill in the art will appreciate that the number of stages provided in each compressor 110 may determine the number of compressors 110 required in the system. Correspondingly, embodiments in which a single compressor 110 is operatively coupled to a driver 102 are contemplated herein.

The plurality of compressors 110 may be fluidly coupled to each other via a network of piping 138. The piping 138 may be formed from a plurality of pipes, commonly referred to as lines or conduits, configured to fluidly connect the compressors 110 in series. The conduits may be further configured to flow therethrough one or more process fluids forming a process fluid stream having a measurable pressure, temperature, and/or mass flow rate. Accordingly, the conduit construction and sizing, e.g., diameter, may vary based on the process fluid flowing therethrough and the accompanying pressure, temperature, and/or mass flow rate of the process fluid.

As shown in FIGS. 1 and 2, the piping 138 includes a system inlet 140 configured to provide an initial process fluid stream fed from a first external fluid source (not shown), such as, for example, a process fluid storage tank, to the sidestream mixing system 100, 200. The initial process fluid stream from the first external fluid source may have a first pressure ($P_1$), temperature ($T_1$), mass flow rate ($M_1$), and volumetric flow rate ($Q_1$). The first external fluid source may be fluidly coupled to a first compressor inlet 142 of the first compressor 118 via the system inlet 140. The process fluid may be compressed in one or more stages in the first compressor 118 and discharged via a first compressor outlet 144 of the first compressor 118. The discharged process fluid, referred to as the first process fluid stream, includes the first mass flow rate ($M_1$), a second pressure ($P_2$), a second volumetric flow rate ($Q_2$), and a second temperature ($T_2$), such that the second pressure ($P_2$) and second temperature ($T_2$) are greater than the first pressure ($P_1$) and temperature ($T_1$); however, because of the increased pressure and temperature, the second volumetric flow rate ($Q_2$) is less than the first volumetric flow rate ($Q_1$). The first compressor outlet 144 may be fluidly coupled to the second compressor 120 via a first conduit 146. In an exemplary embodiment, the first process fluid stream discharged from the first compressor outlet 142 may be fed through the first conduit 146, which forms a first junction 150 with a second conduit 152 upstream of the second compressor 120.

As shown in FIGS. 1 and 2, the first junction 150 may be a connection of a plurality of conduits 146,152 in the form of a "T"-junction, wherein the first conduit 146 and the second conduit 152 are fluidly coupled at the first junction 150 and the first conduit 146 further fluidly couples a second compressor inlet 154 of the second compressor 120 to the first junction 150. In another embodiment, the first junction may form a "Y"-junction. The second conduit 152 may be fluidly coupled to a second external fluid source (not shown) providing a second process fluid stream having a pressure ($P_{S1}$), temperature ($T_{S1}$), mass flow rate ($M_{S1}$), and volumetric flow rate ($Q_{S1}$), such that at least the pressure ($P_{S1}$) may be substantially similar to the second pressure ($P_2$) and, optionally, the temperature ($T_{S1}$) may be substantially similar to the temperature ($T_2$) of the first process fluid stream discharged from the first compressor outlet 144. As such, the second process fluid stream may be referred to as a first sidestream. The second external fluid source may be, for example, a pressurized fluid storage tank. The process fluid from the first compressor outlet 144 and the first sidestream may be mixed at the first junction 150 to form a first combined process fluid stream having a second mass flow rate ($M_2$) and a third volumetric flow rate ($Q_3$). In an exemplary embodiment, the second mass flow rate ($M_2$) may be the summation of the first mass flow rate ($M_1$) and the mass flow rate ($M_{S1}$), and the third volumetric flow rate ($Q_3$) may be the summation of the second volumetric flow rate ($Q_2$) and the volumetric flow rate ($Q_{S1}$). The first combined process fluid stream may be fed to the second compressor inlet 154 via the first conduit 146.

The first junction 150 may be formed in the piping 138 at a distance of at least three pipe internal diameters upstream of the second compressor 120. For example, if the internal pipe diameter of the first conduit 146 is about eight inches, the first junction 150 may be formed at least two feet from the second compressor inlet 154. By mixing the first sidestream with the first process fluid stream at the first junction 150, the mixing of the process fluids is more efficient, and pressure and temperature stratification to disturb the impeller inlet flow is minimalized or eliminated.

The process fluid fed into the second compressor 120 via the first conduit 146 and the second compressor inlet 154 may be compressed in one or more stages and discharged via a second compressor outlet 158. The discharged process fluid referred to as the third process fluid stream includes the second mass flow rate ($M_2$), a third pressure ($P_3$), a fourth volumetric flow rate ($Q_4$), and a third temperature ($T_3$), such that the third pressure ($P_3$) and third temperature ($T_3$) are greater than the second pressure ($P_2$) and temperature ($T_2$); however, because of the increased pressure and temperature, the fourth volumetric flow rate ($Q_4$) is less than the third volumetric flow rate ($Q_3$). The second compressor outlet 158 may be coupled to the third compressor 126 via a third conduit 160. In an exemplary embodiment, the process fluid discharged from the second compressor outlet 158 may be fed through the third conduit 160 forming a second junction 164 with a fourth conduit 166 upstream of the third compressor 126.

As shown in FIGS. 1 and 2, the second junction 164 may be a connection of a plurality of conduits 160,166 in the form of a "T"-junction, such that the third conduit 160 and the fourth conduit 166 are fluidly coupled at the second junction 164 and the third conduit 160 further fluidly couples a third compressor inlet 168 of the third compressor 126 to the second junction 164. In another embodiment, the first junction may form a "Y"-junction. The fourth conduit 166 may be fluidly coupled to a third external fluid source (not shown) providing a fourth process fluid stream having a pressure ($P_{S2}$), temperature ($T_{S2}$), mass flow rate ($M_{S2}$), and volumetric flow rate ($Q_{S2}$), such that at least the pressure ($P_{S2}$) may be substantially similar to the third pressure ($P_3$) and, optionally, the temperature ($T_{S2}$) may be substantially similar to the temperature ($T_3$) of the third process fluid stream discharged from the second compressor outlet 158. As such, the fourth process fluid stream may be referred to as a second sidestream. The third external fluid source may be, for example, a pressurized fluid storage tank. The process fluid from the second compressor outlet 158 and the second sidestream may be mixed at the second junction 164 to form a second combined process fluid stream having a third mass flow rate ($M_3$) and a fifth volumetric flow rate ($Q_5$). In an exemplary embodiment, the third mass flow rate ($M_3$) may be the summation of the second mass flow rate ($M_2$) and the mass flow rate ($M_{S2}$), and the fifth volumetric flow rate ($Q_5$) may be the summation of the fourth volumetric flow rate ($Q_4$) and the volumetric flow rate ($Q_{S2}$). The second combined process fluid stream may be fed to the third compressor inlet 168 via the third conduit 160.

The second junction 164 may be formed in the piping 138 at a distance of at least three pipe internal diameters upstream of the third compressor 126. For example, if the internal pipe diameter of the third conduit 160 is about eight inches, the second junction 164 may be formed at least two feet from the third compressor inlet 168. By mixing the second sidestream with the third process fluid stream at the second junction 164, the mixing of the process fluids is more efficient, and pressure and temperature stratification to disturb the impeller inlet flow is minimalized or eliminated.

The second combined process fluid stream fed into the third compressor 126 via the third conduit 160 and the third compressor inlet 168 may be compressed in one or more stages and discharged via a third compressor outlet 172. The discharged process fluid, referred to as a fifth process fluid stream, includes the third mass flow rate ($M_3$), a fourth pressure ($P_4$), a sixth volumetric flow rate ($Q_6$), and a fourth temperature ($T_4$), such that the fourth pressure ($P_4$) and fourth temperature ($T_4$) are greater than the third pressure ($P_3$) and temperature ($T_3$); however, because of the increased pressure and temperature, the sixth volumetric flow rate ($Q_6$) is less than the fifth volumetric flow rate ($Q_5$). The third compressor outlet 172 may be coupled to the fourth compressor 128 via a fifth conduit 174. In an exemplary embodiment, the fifth process fluid stream discharged from the third compressor outlet 172 may be fed through the fifth conduit 174 forming a third junction 178 with a sixth conduit 180 upstream of the fourth compressor 128.

As shown in FIGS. 1 and 2, the third junction 178 may be a connection of a plurality of conduits 174,180 in the form of a "T"-junction, wherein the fifth conduit 174 and the sixth conduit 180 are fluidly coupled at the third junction 178 and the fifth conduit 174 further fluidly couples a fourth compressor inlet 182 of the fourth compressor 128 to the third junction 178. In another embodiment, the third junction may form a "Y"-junction. The sixth conduit 180 may be fluidly coupled to a fourth external fluid source (not shown) providing a sixth process fluid stream having a pressure ($P_{S3}$), temperature ($T_{S3}$), mass flow rate ($M_{S3}$), and volumetric flow rate ($Q_{S3}$), such that at least the pressure ($P_{S3}$) may be substantially similar to the fourth pressure ($P_4$) and, optionally, the temperature ($T_{S3}$) may be substantially similar to the temperature ($T_4$) of the fifth process fluid stream discharged from the third compressor outlet 172. As such, the sixth process fluid stream may be referred to as a third sidestream. The fourth external fluid source may be, for example, a pressurized fluid storage tank. The process fluid from the third compressor outlet 172 and the third sidestream may be mixed at the third junction 178 to form a third combined process fluid stream having a fourth mass flow rate ($M_4$) and a seventh volumetric flow rate ($Q_7$). In an exemplary embodiment, the fourth mass flow rate ($M_4$) may be the summation of the third mass flow rate ($M_3$) and the mass flow rate ($M_{S3}$), and the seventh volumetric flow rate ($Q_7$) may be the summation of the sixth volumetric flow rate ($Q_6$) and the volumetric flow rate ($Q_{S3}$). The third combined process fluid stream may be fed to the fourth compressor inlet 182 via the fifth conduit 174.

The third junction 178 may be formed in the piping 138 at a distance of at least three pipe internal diameters upstream of the fourth compressor 128. For example, if the internal pipe diameter of the fifth conduit 174 is about eight inches, the third junction 178 may be formed at least two feet from the fourth compressor inlet 182. By mixing the third sidestream with the fifth process fluid stream at the third junction 178, the mixing of the process fluids is more efficient, and pressure and temperature stratification to disturb the impeller inlet flow is minimalized or eliminated.

The process fluid fed into the fourth compressor 128 via the fifth conduit 174 and the fourth compressor inlet 182 may be compressed in one or more stages and discharged via a fourth compressor outlet 186 having the mass flow rate ($M_4$), a system outlet pressure ($P_5$), temperature ($T_5$), and volumetric flow rate ($Q_8$). The fourth compressor outlet 186 may be coupled to a system outlet 188. The system outlet 188 may be further fluidly coupled to one or more downstream processing components (not shown) configured to further process the exiting process fluid.

Figure 3:
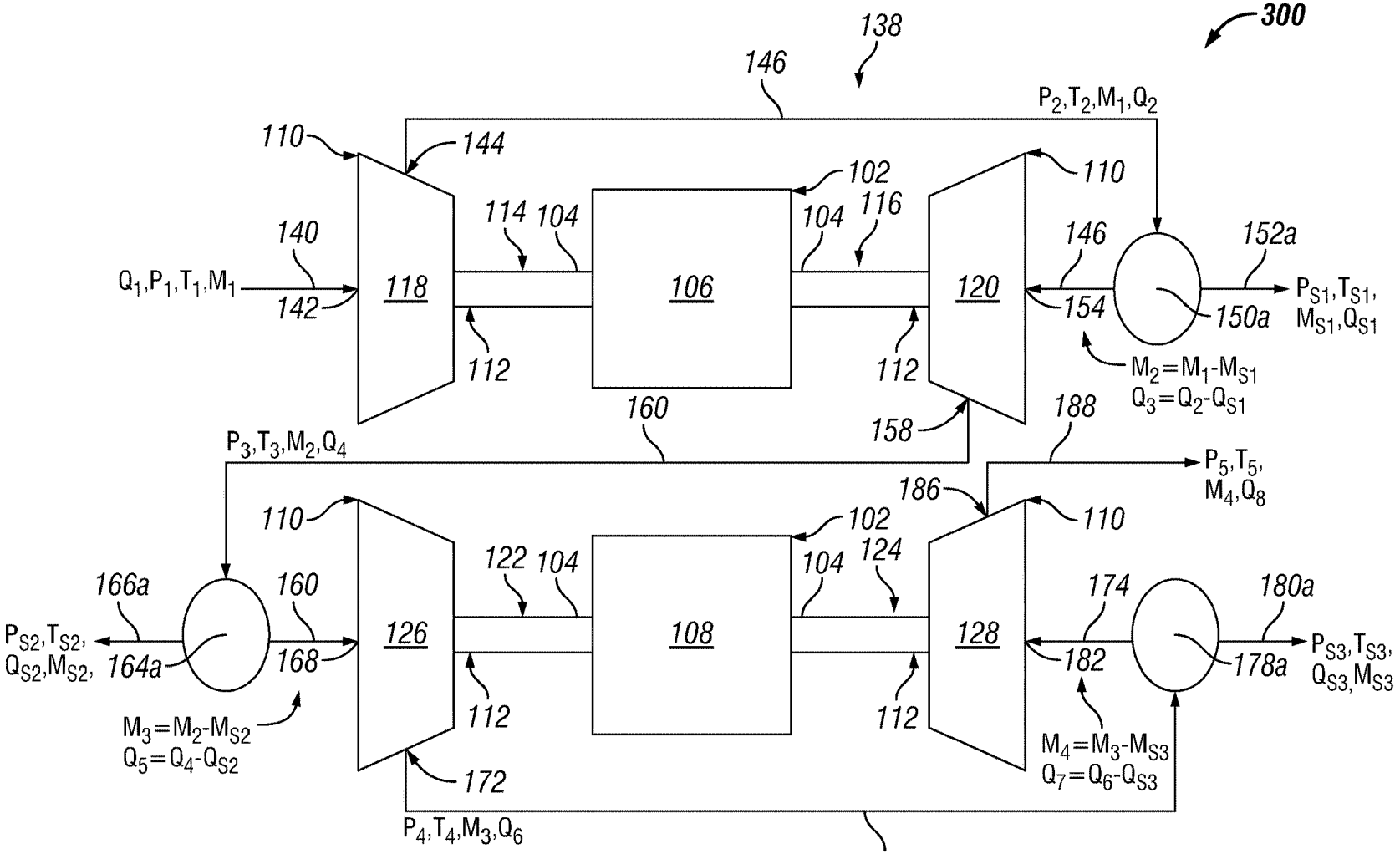
FIG. 3 illustrates a schematic diagram of a system for removing at least a portion of a process fluid, the system including a plurality of compressors and a plurality of drivers, wherein at least one sidestream may provide process fluid to an external process component, according to one or more embodiments.
Figure 4:
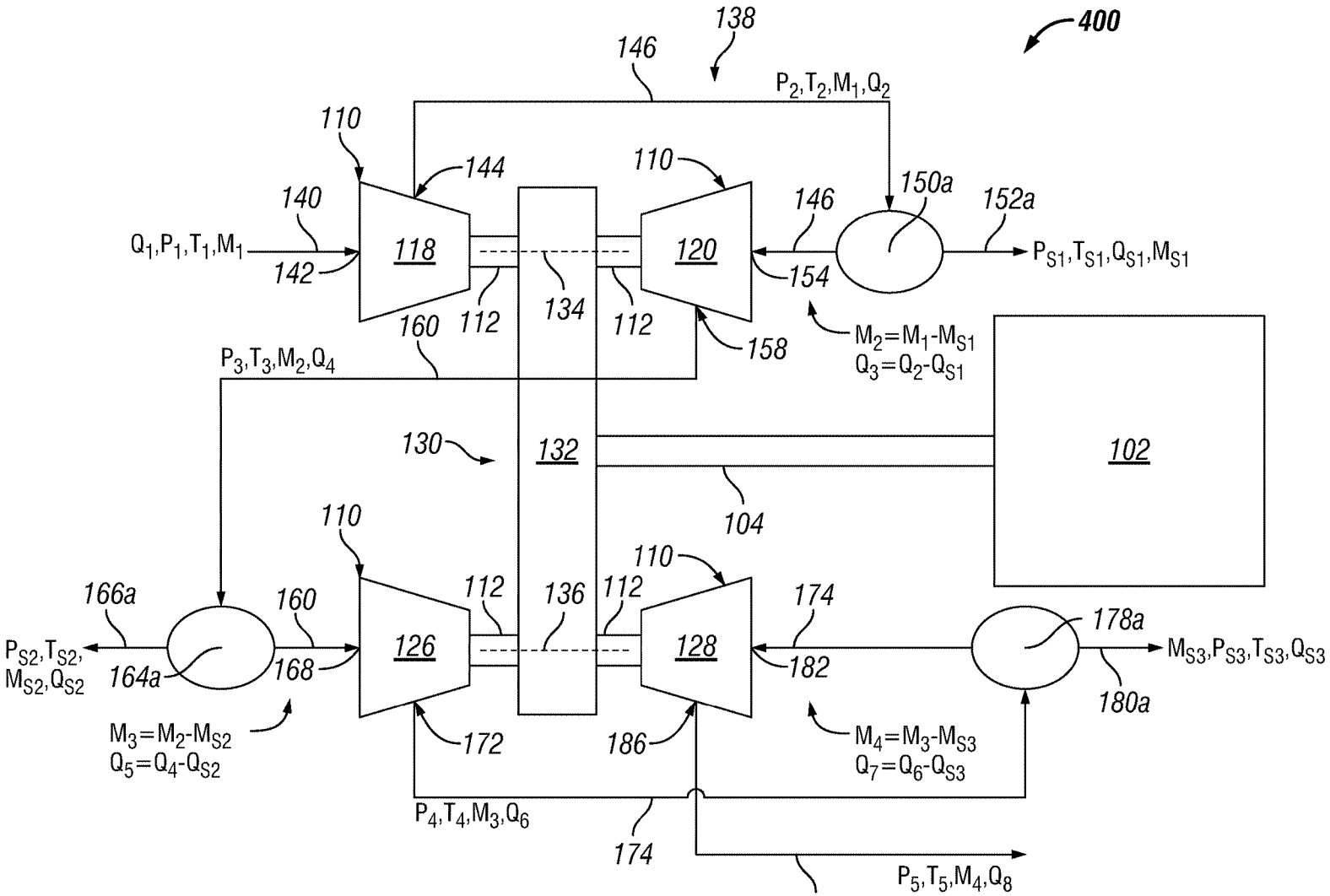
FIG. 4 illustrates a schematic diagram of another system for removing at least a portion of a process fluid, the system including a plurality of compressors operatively coupled to a driver via a plurality of gears, wherein at least one sidestream may provide process fluid to an external process component, according to one or more embodiments.

Looking now at the exemplary embodiments illustrated in FIGS. 3 and 4, a system 300, 400 is provided for removing via one or more sidestreams at least a portion of a process fluid. The process fluid removal system 300, 400 may be similar in some respects to the sidestream mixing system 100, 200 described above and therefore may be best understood with reference to the description of FIGS. 1 and 2 where like numerals designate like components and will not be described again in detail.

The piping 138 includes a system inlet 140 configured to provide an initial process fluid stream fed from a first external fluid source (not shown), such as, for example, a process fluid storage tank, to the process fluid removal system 300, 400. The initial process fluid stream from the first external fluid source may have a first pressure ($P_1$), temperature ($T_1$), mass flow rate ($M_1$), and volumetric flow rate ($Q_1$). The first external fluid source may be fluidly coupled to a first compressor inlet 142 of the first compressor 118 via the system inlet 140. The process fluid may be compressed in one or more stages in the first compressor 118 and discharged via a first compressor outlet 144 of the first compressor 118. The discharged process fluid, referred to as the first process fluid stream, includes the first mass flow rate ($M_1$), a second pressure ($P_2$), a second volumetric flow rate ($Q_2$), and a second temperature ($T_2$), such that the second pressure ($P_2$) and second temperature ($T_2$) are greater than the first pressure ($P_1$) and temperature ($T_1$); however, because of the increased pressure and temperature, the second volumetric flow rate ($Q_2$) is less than the first volumetric flow rate ($Q_1$). The first compressor outlet 144 may be fluidly coupled to the second compressor 120 via a first conduit 146. In an exemplary embodiment, the first process fluid stream discharged from the first compressor outlet 142 may be fed through the first conduit 146, which forms a first junction 150*a* with a second conduit 152*a* upstream of the second compressor 120.

The first junction 150*a* may be a connection of a plurality of conduits 146,152*a* in the form of a "T"-junction, wherein the first conduit 146 and the second conduit 152*a* are fluidly coupled at the first junction 150*a*, and the first conduit 146 further fluidly couples the second compressor inlet 154 of the second compressor 120 to the first junction 150*a*. In another embodiment, the first junction may form a "Y"-junction. The second conduit 152*a* may be fluidly coupled to a first external process component (not shown) and may provide the first external process component with a portion of the first process fluid stream compressed from the first compressor 118 and having a pressure ($P_{S1}$), temperature ($T_{S1}$), mass flow rate ($M_{S1}$), and volumetric flow rate ($Q_{S1}$). The portion of the first process fluid stream fed to the first external process component from the first junction 150*a* may be referred to as the primary sidestream and may be fed to the first external process component via the second conduit 152*a*. The remaining process fluid stream of the first process fluid stream may have a second mass flow rate ($M_2$) and a third volumetric flow rate ($Q_3$). In an exemplary embodiment, the second mass flow rate ($M_2$) may be the difference between the first mass flow rate ($M_1$) and the mass flow rate ($M_{S1}$), and the third volumetric flow rate ($Q_3$) may be the difference between the second volumetric flow rate ($Q_2$) and the volumetric flow rate ($Q_{S1}$). The remaining process fluid stream of the first process fluid stream may be fed to the second compressor inlet 154 via the first conduit 146. The first junction 150*a* may be formed in the piping 138 at least three pipe internal diameters upstream of the second compressor 120.

The process fluid fed into the second compressor 120 via the first conduit 146 and the second compressor inlet 154 may be compressed in one or more stages and discharged via a second compressor outlet 158. The discharged process fluid referred to as the third process fluid stream includes the second mass flow rate ($M_2$), a third pressure ($P_3$), a fourth volumetric flow rate ($Q_4$), and a third temperature ($T_3$), such that the third pressure ($P_3$) and third temperature ($T_3$) are greater than the second pressure ($P_2$) and temperature ($T_2$); however, because of the increased pressure and temperature, the fourth volumetric flow rate ($Q_4$) is less than the third volumetric flow rate ($Q_3$). The second compressor outlet 158 may be coupled to the third compressor 126 via a third conduit 160. In an exemplary embodiment, the process fluid discharged from the second compressor outlet 158 may be fed through the third conduit 160 forming a second junction 164*a* with a fourth conduit 166*a* upstream of the third compressor 126.

In the exemplary embodiments illustrated in FIGS. 3 and 4, the second junction 164*a* may be a connection of a plurality of conduits 160,166*a* in the form of a "T"-junction, wherein the third conduit 160 and the fourth conduit 166*a* are fluidly coupled at the second junction 164*a*, and third conduit 160 further fluidly couples the third compressor inlet 168 of the third compressor 126 to the second junction 164*a*. In another embodiment, the second junction 164*a* may form a "Y"-junction. The fourth conduit 166*a* may be fluidly coupled to a second external process component (not shown) and may provide the second external process component with a portion of the third process fluid stream compressed from the second compressor 120 and having a pressure ($P_{S2}$), temperature ($T_{S2}$), mass flow rate ($M_{S2}$), and volumetric flow rate ($Q_{S2}$). The portion of the third process fluid stream fed to the second external process component from the second junction 164*a* may be referred to as the secondary sidestream and may be fed to the second external process component via the fourth conduit 166*a*. The remaining process fluid stream of the third process fluid stream may have a third mass flow rate ($M_3$) and a fifth volumetric flow rate ($Q_5$). In an exemplary embodiment, the third mass flow rate ($M_3$) may be the difference between the second mass flow rate ($M_2$) and the mass flow rate ($M_{S2}$), and the fifth volumetric flow rate ($Q_5$) may be the difference between the fourth volumetric flow rate ($Q_4$) and the volumetric flow rate ($Q_{S2}$). The remaining process fluid stream of the third process fluid stream may be fed to the third compressor inlet 168 via the third conduit 160. The second junction 164*a* may be formed in the piping 138 at a distance of at least three pipe internal diameters upstream of the third compressor 126.

The second combined process fluid stream fed into the third compressor 126 via the third conduit 160 and the third compressor inlet 168 may be compressed in one or more stages and discharged via a third compressor outlet 172. The discharged process fluid, referred to as a fifth process fluid stream, includes the third mass flow rate ($M_3$), a fourth pressure ($P_4$), a sixth volumetric flow rate ($Q_6$), and a fourth temperature ($T_4$), such that the fourth pressure ($P_4$) and fourth temperature ($T_4$) are greater than the third pressure ($P_3$) and temperature ($T_3$); however, because of the increased pressure and temperature, the sixth volumetric flow rate ($Q_5$) is less than the fifth volumetric flow rate ($Q_5$). The third compressor outlet 172 may be coupled to the fourth compressor 128 via a fifth conduit 174. In an exemplary embodiment, the fifth process fluid stream discharged from the third compressor outlet 172 may be fed through the fifth conduit 174 forming a third junction 178*a* with a sixth conduit 180*a* upstream of the fourth compressor 128.

In the exemplary embodiments illustrated in FIGS. 3 and 4, the third junction 178*a* may be a connection of a plurality of conduits 174, 180*a* in the form of a "T"-junction, wherein the fifth conduit 174 and the sixth conduit 180*a* are fluidly coupled at the third junction 178*a*, and the fifth conduit 174 further fluidly couples the fourth compressor inlet 182 of the fourth compressor 128 to the third junction 178*a*. In another embodiment, the third junction 178*a* may form a "Y"-junction. The sixth conduit 180*a* may be fluidly coupled to a third external process component (not shown) and may provide the third external process component with a portion of the fifth process fluid stream compressed from the third compressor 126 and having a pressure ($P_{S3}$), temperature ($T_{S3}$), mass flow rate ($M_{S3}$), and volumetric flow rate ($Q_{S3}$). The portion of the fifth process fluid stream fed to the third external process component from the third junction 178*a* may be referred to as the tertiary sidestream and may be fed to the third external process component via the sixth conduit 180*a*. The remaining process fluid stream of the fifth process fluid stream may have a fourth mass flow rate ($M_4$) and a seventh volumetric flow rate ($Q_7$). In an exemplary embodiment, the fourth mass flow rate ($M_4$) may be the difference between the third mass flow rate ($M_3$) and the mass flow rate ($M_{S3}$), and the seventh volumetric flow rate ($Q_7$) may be the difference between the sixth volumetric flow rate ($Q_6$) and the volumetric flow rate ($Q_{S3}$). The remaining process fluid stream of the fifth process fluid stream may be fed to the fourth compressor inlet 182 via the fifth conduit 174. The third junction 178*a* may be formed in the piping 138 at least three pipe internal diameters upstream of the fourth compressor 128.

The process fluid fed into the fourth compressor 128 via the fifth conduit 174 and the fourth compressor inlet 182 may be compressed in one or more stages and discharged via a fourth compressor outlet 186 having the mass flow rate ($M_4$), a system outlet pressure ($P_5$), temperature ($T_5$), and volumetric flow rate ($Q_8$). The fourth compressor outlet 186 may be coupled to a system outlet 188. The system outlet 188 may be further fluidly coupled to one or more downstream processing components (not shown) configured to further process the exiting process fluid.

Figure 5:
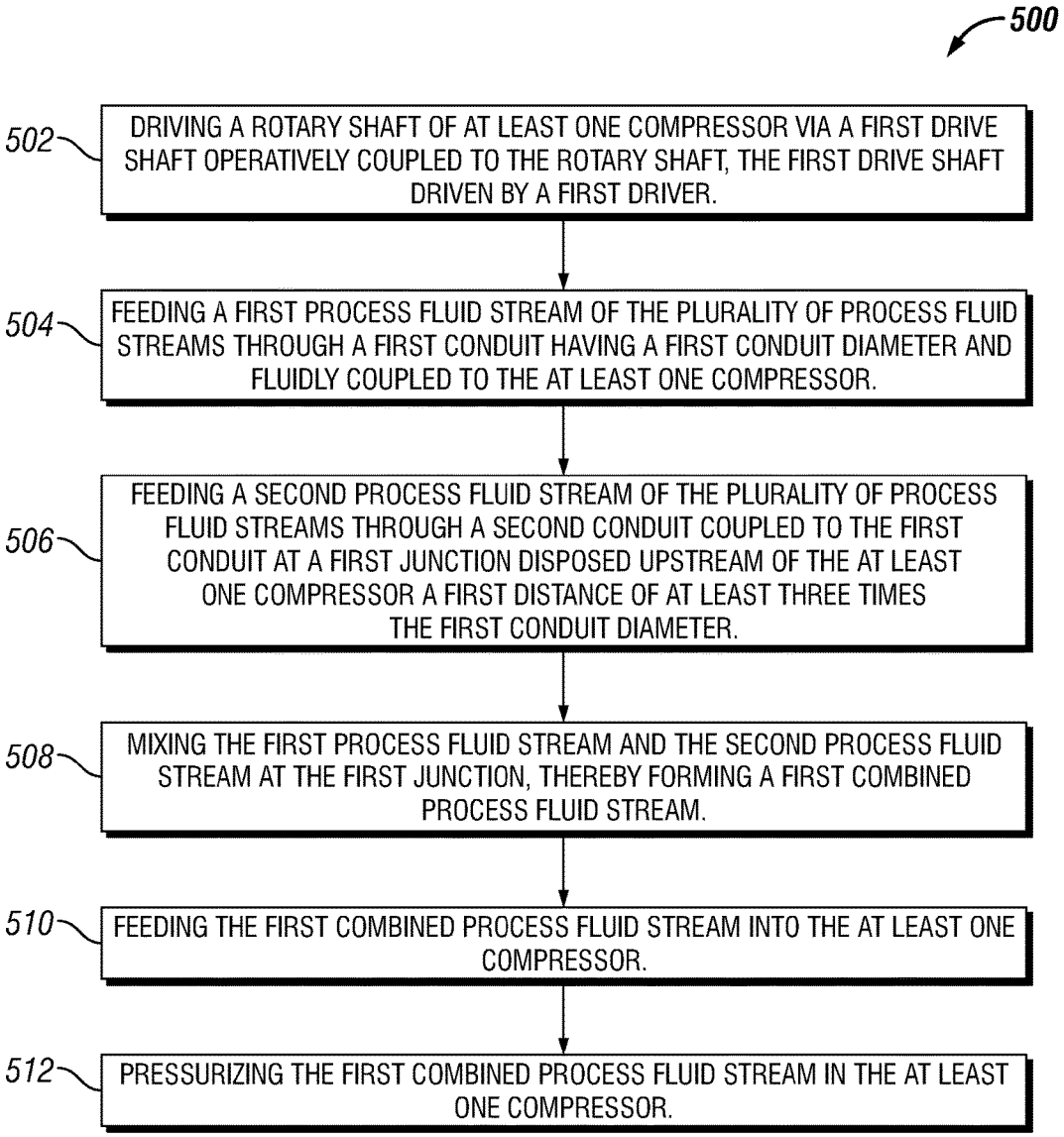
FIG. 5 illustrates a flowchart of an exemplary method for mixing and pressurizing a plurality of process fluid streams, according to one or more embodiments.

FIG. 5 illustrates a flowchart of an exemplary method 500 for mixing and pressurizing a plurality of process fluid streams. The method 500 may include driving a rotary shaft of at least one compressor via a first drive shaft operatively coupled to the rotary shaft, the first drive shaft driven by a first driver, as at 502. The method 500 may also include feeding a first process fluid stream of the plurality of process fluid streams through a first conduit having a first conduit diameter and fluidly coupled to the at least one compressor, as at 504. The method 500 may further include feeding a second process fluid stream of the plurality of process fluid streams through a second conduit coupled to the first conduit at a first junction disposed upstream of the at least one compressor a first distance of at least three times the first conduit diameter, as at 506. The method 500 may also include mixing the first process fluid stream and the second process fluid stream at the first junction, thereby forming a first combined process fluid stream, as at 508. The method 500 may further include feeding the first combined process fluid stream into the at least one compressor, as at 510, and pressurizing the first combined process fluid stream in the at least one compressor, as at 512.

Figure 6:
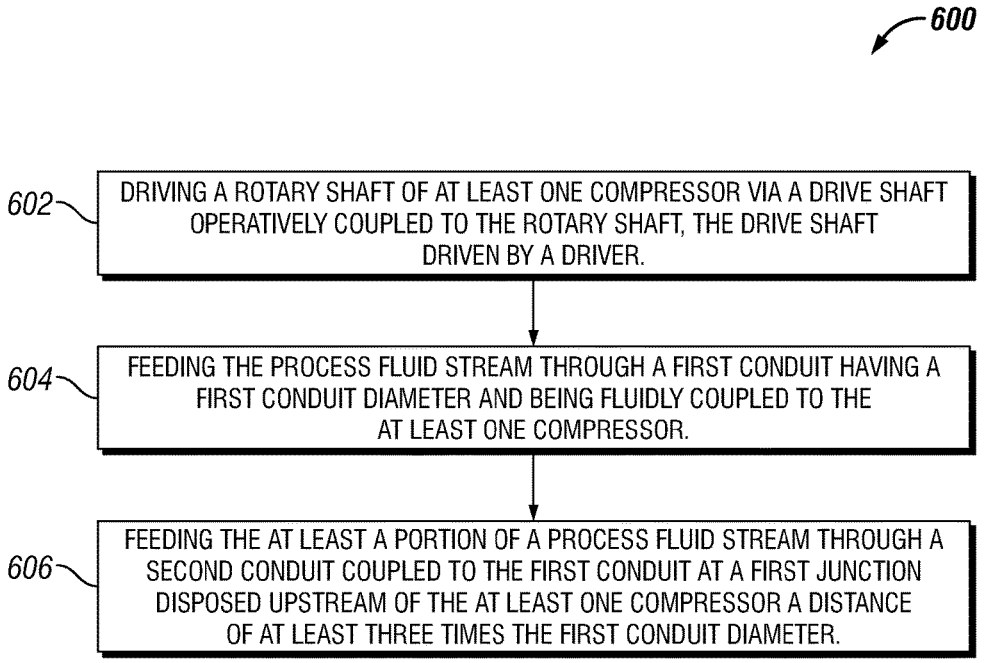
FIG. 6 illustrates a flowchart of an exemplary method for removing at least a portion of a process fluid stream, according to one or more embodiments.

FIG. 6 illustrates a flowchart of an exemplary method 600 for removing at least a portion of a process fluid stream. The method 600 may include driving a rotary shaft of at least one compressor via a drive shaft operatively coupled to the rotary shaft, the drive shaft driven by a driver, as at 602. The method 600 may also include feeding the process fluid stream through a first conduit having a first conduit diameter and being fluidly coupled to the at least one compressor, as at 604. The method 600 may further include feeding the at least a portion of a process fluid stream through a second conduit coupled to the first conduit at a first junction disposed upstream of the at least one compressor a distance of at least three times the first conduit diameter, thereby removing the at least a portion of the process fluid stream from the process fluid stream, as at 606.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A system for removing at least a portion of a process fluid stream, comprising:

at least one driver comprising a drive shaft, the at least one driver configured to provide the drive shaft with rotational energy;

a first compressor comprising a rotary shaft, the rotary shaft being operatively coupled to the drive shaft and configured such that the rotational energy from the drive shaft is transmitted to the rotary shaft;

a second compressor comprising a rotary shaft, the rotary shaft of the second compressor being operatively coupled to the drive shaft and configured such that the rotational energy from the drive shaft is transmitted to the rotary shaft of the second compressor;

a first junction formed from a first plurality of conduits comprising:

a first conduit fluidly coupling the first compressor and the second compressor, the first conduit forming a first conduit diameter and configured to flow therethrough the process fluid stream; and a second conduit fluidly coupled to the first conduit and a first external component, the second conduit configured to flow therethrough at least a first portion of the process fluid stream, wherein the first junction is disposed between the first compressor and the second compressor at a first distance at least three times the diameter of the first conduit upstream of at least one of the first compressor or the second compressor, such that the at least a first portion of the process fluid stream is removed from the process fluid stream and fed to the first external component via the second conduit;

a third compressor comprising a rotary shaft and a fourth compressor comprising a rotary shaft, wherein the at least one driver comprises:

a first driver comprising a first drive shaft comprising a first drive shaft first end and a first drive shaft second end, the first drive shaft first end being integral with or coupled to the rotary shaft of the first compressor and the first drive shaft second end being integral with or coupled to the rotary shaft of the second compressor;

a second driver comprising a second drive shaft comprising a second drive shaft first end and a second drive shaft second end, the second drive shaft first end being integral with or coupled to the rotary shaft of the third compressor and the second drive shaft second end being integral with or coupled to the rotary shaft of the fourth compressor;

a second junction formed from a second plurality of conduits comprising:

a third conduit fluidly coupling the second compressor and the third compressor, the third conduit forming a second conduit diameter and configured to flow therethrough the process fluid stream; and a fourth conduit fluidly coupled to the third conduit and at least one of the first external component and a second external component, the fourth conduit configured to flow therethrough at least a second portion of the process fluid stream; and wherein the second junction is disposed between the second compressor and the third compressor at a second distance at least three times the diameter of the third conduit upstream of the third compressor, such that the at least a second portion of the process fluid stream is removed from the process fluid stream and fed to the at least one of the first external component and the second external component via the fourth conduit.

2. The system of claim 1, further comprising:

a third junction formed from a third plurality of conduits comprising:

a fifth conduit fluidly coupling the third compressor and the fourth compressor, the fifth conduit forming a third conduit diameter and configured to flow therethrough the process fluid stream; and a sixth conduit fluidly coupled to the fifth conduit and at least one of the first external component, the second external component, and a third external component, the sixth conduit configured to flow therethrough at least a third portion of the process fluid stream, wherein the third junction is disposed between the third compressor and the fourth compressor at a third distance at least three times the diameter of the fifth conduit upstream of the fourth compressor, such that the at least a third portion of the process fluid stream is removed from the process fluid stream and fed to the at least one of the first external component, the second external component, and the third external component via the sixth conduit.

3. The system of claim 1, further comprising a third compressor comprising a rotary shaft and a fourth compressor comprising a rotary shaft, wherein the drive shaft is operatively coupled to a plurality of gears, such that the plurality of gears transmit rotational energy from the drive shaft to the rotary shafts of the respective first compressor, second compressor, third compressor and fourth compressor.

4. The system of claim 3, wherein the plurality of gears comprises:

a first gear integral with or coupled to the drive shaft;

a second gear integral with or coupled to the rotary shaft of the first compressor and the second compressor; and a third gear integral with or coupled to the rotary shaft of the third compressor and the fourth compressor, wherein the first gear is operatively coupled to the second gear and the third gear.

5. The system of claim 4, wherein the first gear is a bull gear, the second gear is a first pinion, and the third gear is a second pinion, each of the first pinion and the second pinion having an identical gearing ratio with the bull gear.

6. The system of claim 5, wherein the first gear is a bull gear, the second gear is a first pinion, and the third gear is a second pinion, each of the first pinion and the second pinion having different gearing ratios with the bull gear.

7. The system of claim 6, further comprising:

a second junction formed from a second plurality of conduits comprising:

a third conduit fluidly coupling the second compressor and the third compressor, the third conduit forming a second conduit diameter and configured to flow therethrough the process fluid stream; and a fourth conduit fluidly coupled to the third conduit and at least one of the first external component and a second external component, the fourth conduit configured to flow therethrough at least a second portion of the process fluid stream, wherein the second junction is disposed between the second compressor and the third compressor at a second distance at least three times the diameter of the third conduit upstream of the third compressor, such that the at least a second portion of the process fluid stream is removed from the process fluid stream and fed to the at least one of the first external component and the second external component via the fourth conduit.

8. The system of claim 7, further comprising:

a third junction formed from a third plurality of conduits comprising:

a fifth conduit fluidly coupling the third compressor and the fourth compressor, the fifth conduit forming a third conduit diameter and configured to flow therethrough the process fluid stream; and a sixth conduit fluidly coupled to the fifth conduit and at least one of the first external component, the second external component, and a third external component, the sixth conduit configured to flow therethrough at least a third portion of the process fluid stream, wherein the third junction is disposed between the third compressor and the fourth compressor at a third distance at least three times the diameter of the fifth conduit upstream of the fourth compressor, such that the at least a third portion of the process fluid stream is removed from the process fluid stream and fed to the at least one of the first external component, the second external component, and the third external component via the sixth conduit.

9. A method for removing at least a portion of a process fluid stream, comprising:

driving a rotary shaft of a first compressor via a first drive shaft operatively coupled to the rotary shaft, the first drive shaft driven by a first driver;

driving a rotary shaft of a second compressor via the first drive shaft operatively coupled to the rotary shaft of the second compressor;

feeding the process fluid stream through a first conduit having a first conduit diameter and fluidly coupling the first compressor and the second compressor;

feeding at least a first portion of a process fluid stream through a second conduit coupled to the first conduit at a first junction disposed between the first compressor and the second compressor, and upstream of the second compressor a distance of at least three times the first conduit diameter, thereby removing the at least a first portion of a process fluid stream from the process fluid stream; and driving a rotary shaft of a third compressor via a second drive shaft operatively coupled to the rotary shaft of the third compressor, the second drive shaft driven by a second driver;

feeding the process fluid stream through a third conduit having a second conduit diameter and fluidly coupling the second compressor and the third compressor; and feeding at least a second portion of a process fluid stream through a fourth conduit coupled to the third conduit at a second junction disposed between the second compressor and the third compressor, and upstream of the third compressor a distance of at least three times the second conduit diameter, thereby removing the at least a second portion of the process fluid stream from the process fluid stream.

10. The method of claim 9, further comprising:

driving a rotary shaft of a fourth compressor via the second drive shaft operatively coupled to the rotary shaft of the fourth compressor;

feeding the process fluid stream through a fifth conduit having a third conduit diameter and fluidly coupling the third compressor and the fourth compressor; and feeding at least a third portion of a process fluid stream through a sixth conduit coupled to the fifth conduit at a third junction disposed between the third compressor and the fourth compressor, and upstream of the fourth compressor a distance of at least three times the third conduit diameter, thereby removing the at least a third portion of the process fluid stream from the process fluid stream.

11. The method of claim 10, wherein:

the first drive shaft comprises a first drive shaft first end and a first drive shaft second end, the first drive shaft first end being integral with or coupled to the rotary shaft of the first compressor and the first drive shaft second end being integral with or coupled to the rotary shaft of the second compressor; and the second drive shaft comprises a second drive shaft first end and a second drive shaft second end, the second drive shaft first end being integral with or coupled to the rotary shaft of the third compressor and the second drive shaft second end being integral with or coupled to the rotary shaft of the fourth compressor.

12. The method of claim 9, further comprising:

driving a rotary shaft of a third compressor via the first driveshaft;

feeding the process fluid stream through a third conduit having a second conduit diameter and fluidly coupling the second compressor and the third compressor; and feeding at least a second portion of a process fluid stream through a fourth conduit coupled to the third conduit at a second junction disposed between the second compressor and the third compressor, and upstream of the third compressor a distance of at least three times the second conduit diameter, thereby removing the at least a second portion of the process fluid stream from the process fluid stream.

13. The method of claim 12, further comprising:

driving a rotary shaft of a fourth compressor via the first drive shaft;

feeding the process fluid stream through a fifth conduit having a third conduit diameter and fluidly coupling the third compressor and the fourth compressor; and feeding at least a third portion of a process fluid stream through a sixth conduit coupled to the fifth conduit at a third junction disposed between the third compressor and the fourth compressor, and upstream of the fourth compressor a distance of at least three times the third conduit diameter, thereby removing the at least a third portion of the process fluid stream from the process fluid stream.

14. The method of claim 13, wherein the first drive shaft is operatively coupled to a plurality of gears, such that the plurality of gears transmit rotational energy from the drive shaft to the rotary shafts of the respective first compressor, second compressor, third compressor and fourth compressor.

15. The method of claim 14, wherein the plurality of gears comprises:

a first gear integral with or coupled to the first drive shaft;

a second gear integral with or coupled to the rotary shaft of the first compressor and the second compressor; and a third gear integral with or coupled to the rotary shaft of the third compressor and the fourth compressor, wherein the first gear is operatively coupled to the second gear and the third gear.

16. The method of claim 15, wherein the first gear is a bull gear, the second gear is a first pinion, and the third gear is a second pinion, each of the first pinion and the second pinion having an identical gearing ratio with the bull gear.

17. The method of claim 15, wherein the first gear is a bull gear, the second gear is a first pinion, and the third gear is a second pinion, each of the first pinion and the second pinion having different gearing ratios with the bull gear.

* * * * *